US012187520B2

(12) United States Patent
Li

(10) Patent No.: US 12,187,520 B2
(45) Date of Patent: Jan. 7, 2025

(54) FOOD GRAVITY BOX WITH SEALED FLOW CHANNEL FOR FRESHNESS PRESERVATION AND DISPLAY

(71) Applicant: Jiangxi Eco Technology Group Co., Ltd., Nanchang (CN)

(72) Inventor: Guoping Li, Nanchang (CN)

(73) Assignee: Jiangxi Enco Intelligence Technology Co., Ltd, Nanchang (CN)

( * ) Notice: Subject to any disclaimer, the term of this patent is extended or adjusted under 35 U.S.C. 154(b) by 150 days.

(21) Appl. No.: 17/992,965

(22) Filed: Nov. 23, 2022

(65) Prior Publication Data

US 2023/0234768 A1 Jul. 27, 2023

(30) Foreign Application Priority Data

Jan. 27, 2022 (CN) ..... 202210097623.X

(51) Int. Cl.
*B65D 81/24* (2006.01)
*A47F 1/03* (2006.01)
*B65D 83/06* (2006.01)

(52) U.S. Cl.
CPC ..... *B65D 81/24* (2013.01); *A47F 1/03* (2013.01); *B65D 83/06* (2013.01); *B65D 2203/12* (2013.01)

(58) Field of Classification Search
CPC ..... A47J 47/01; A47F 1/03; B65B 39/003; B65B 39/004; B65D 47/26; B65D 81/24; B65D 83/06; B65D 2203/12
See application file for complete search history.

(56) References Cited

U.S. PATENT DOCUMENTS 6,702,154 B2 * 3/2004 Ellis ..... A47J 47/01 222/1
2010/0282770 A1 * 11/2010 Mendes ..... B65B 39/003 221/282
2018/0155141 A1 * 6/2018 Brundick ..... B65D 88/66
2021/0106147 A1 * 4/2021 Sunesson ..... A47F 1/03

* cited by examiner

*Primary Examiner* — Vishal Pancholi
*Assistant Examiner* — Robert K Nichols, II

(57) ABSTRACT

A food gravity box with sealed flow channel for freshness preservation and display, includes a container device integrally formed by injection molding, The container includes a display room and a storage room with semi-elliptical sections separated by a partition plate. The storage room is composed of a partition plate, a front panel, a rear panel, a first side panel with a fillet and a first bottom panel which is obliquely arranged. Included are a first discharging port formed in the bottom of the storage room, a sealing device used for sealing the feeding port in the upper portion of the container barrel, and a discharging control device connected to the first discharging port, between which a first sealing ring is arranged.

8 Claims, 6 Drawing Sheets

FOOD GRAVITY BOX WITH SEALED FLOW CHANNEL FOR FRESHNESS PRESERVATION AND DISPLAY

CROSS REFERENCE TO RELATED APPLICATIONS

This application claims priority benefit to Chinese Patent Application No. 202210097623.X, filed on Jan. 27, 2022, the content of which is incorporated herein by reference.

TECHNICAL FIELD

The present application relates to the technical field of food gravity box, in particular, the present application relates to a food gravity box with sealed flow channel for freshness preservation and display.

BACKGROUND

Small particles of dried fruits snack such as soybeans, rice, sunflower seeds and pistachios are indispensable food and leisure food in people's daily life. These goods are generally sold in supermarkets, markets and other specific places because they are usually in bulk packaging and people have various quantity needs for them. As the labor cost is rising and the modern society is pursuing precision and high efficiency, food gravity box plays an outstanding role in today's life.

Generally, the food gravity box includes a relatively large storage container, a flow channel and a flow path switch. When in use, turn on the switch connected to the channel and the food in the storage container will flow down through the channel with the action of gravity.

However, the shortcoming of the current applications is that most of the gravity boxes existing in the market are combined by several parts, in which especially the storage container that involves too many panels causes poor sealing performance which leads the inner food to deteriorate after some time for it absorbs too much moisture from the air.

SUMMARY

To deal with the above-mentioned problems, the present application aims to solve the problem of poor sealing performance of the gravity box, and to provide a food gravity box with sealed flow channel for freshness preservation and display, and to improve the function of gravity boxes in preserving food freshness by overall sealing for the container device integrally formed through injection molding, the sealing ring and the discharging control device.

The above technical goals of the present application are achieved by the following technical solutions, including:

A container device integrally formed through injection molding which has a display room and a storage room, with semi-elliptical sections, separated by a partition plate; wherein the storage room is composed of a partition plate, a front panel, a rear panel, the first side panel with a fillet and the first bottom panel which is obliquely arranged and a first discharging port is formed in the bottom of the storage room:

A sealing device used for sealing up the upper feeding port of the container;

A discharging control device communicated with the first discharging port which comprises a flow path switch for sealing a first discharging port, a twist handle for pulling the flow path switch to rotate and the second discharging port.

There is the first sealing ring between the discharging control device and the first discharging port.

Preferably, the sealing device comprises a sealing cover board and a second sealing ring, wherein the sealing cover board is provided with a convex serrated ring along the bottom edge, and a concave serrated ring is arranged at the bottom inner ring of the second sealing ring, wherein the above convex serrated ring is buckled with the concave serrated ring.

Preferably, right below the first bottom panel, there is a fixing base in right-angled triangle which is provided with an inclined panel attached to the first bottom panel. The first bottom panel has a base buckle and the inclined panel is provided with a snap groove, wherein the base buckle is embedded into the snap groove.

Preferably, the discharging control device is provided with a first hanging hole unit, and a first hanging buckle is arranged on the section of the first bottom panel close to the first discharge port, wherein the first hanging buckle has an arc-shaped section and penetrates through the first hanging hole unit.

Preferably, the display room is composed of the partition plate, the second side panel and the second bottom panel arranged obliquely, wherein the second side panel is made of transparent material. The bottom part of the display room has a second hanging hole unit composed of the second bottom panel and the second side panel. The discharging control device is provided with a second hanging buckle which is used for buckling the second hanging hole unit.

Preferably, the second hanging hole unit comprises the second bottom panel, a vertical plate and a horizontal plate. The second hanging buckle is in the shape of FIG. 7 and includes a support rod and a fastener rod, wherein the support rod runs through the hanging buckle channel set on the hollow horizontal plate and the fastener rod is butting and buckled with the horizontal plate.

Preferably, the second hanging hole unit is internally provided with a detachable tightening buckle which comprises a plug-in rod and an elastic shifting piece installed with a stop rod. The horizontal plate has a hollow-out stop groove for placing the stop rod.

Preferably, the front panel and the rear panel are symmetrically provided with side bases.

Preferably, the second side panel surface is provided with a detachable signboard.

The principle of the present application is as follows: the container device which is integrally molded by injection molding has only two channels, namely the feeding port and the first discharging port, wherein the feeding port is sealed by the sealing device, and the joint of the first discharging port and the discharging control device is sealed by the first sealing ring and the flow path switch, so that the food in the gravity box is completely enclosed, which improves the fresh-keeping capability of the gravity box.

In conclusion, the present application has the following benefits:

Firstly, a convex serration made of hard rubber material is snap connected to the concave serration made of soft rubber material, so that the sealing performance of the sealing device to the feeding port is stronger:

Secondly, the fixing base shaped in right-angled triangle is lied on a plane, and the snap groove on the inclined plane is buckled with the base buckle, in order to secure the stability of the gravity box when it is set;

Thirdly, the first hanging buckle penetrates through the first hanging hole unit, and because the cross section of the first hanging buckle is arc-shaped, the buckling force of the discharging control device and the container device will be enhanced when the first hanging buckle is rotated and buckled by taking itself as the origin. And the arc-shaped cross section of the first hanging buckle facilitates the installation of the gravity box, which only needs to insert the first hanging buckle into the first hanging hole unit and then rotate the discharging control device;

Fourthly, coordinating the first hanging hole unit and the first hanging buckle, the second hanging hole unit and the second hanging buckle fix the discharging control device and the container device through the two sides of the first discharging port, and ensure the sealing performance between the discharging control device and the container device with the first sealing ring. The second side panel is made of transparent material which allows customers to observe the condition of food in the display room:

Fifthly, a plug-in rod is installed between a hanging buckle rod and a horizontal plate in order to intensify the tightness between them so that it can improve the sealing performance between the discharging control device and the container device:

Sixthly, through a side base the gravity box can be fixed on the wall, and be various in its display ways:

Seventhly, a signboard is used for clarify the information of a product, including name, price, and production date, etc.

DETAILED DESCRIPTION OF THE EMBODIMENTS

The present application will be described in detail below with reference to the figures and embodiments.

In describing the present application, it is to be appreciated that the terminologies that indicates orientation or the relation of position, such as "center", "longitudinal," "transverse," "length," "width," "thickness," "upper," "lower," "front," "rear," "left," "right," "vertical," "horizontal," "top," "bottom," "inner," "outer," "clockwise," "counterclockwise," "axial," "radial," "circumferential," and the like are based on the orientation or positional relationships shown in the figures and are merely for convenience in describing the present application. They are not for indicating or implying that the weight or element must have a particular orientation or be constructed and operated in a particular orientation, so it should not be taken in a limiting sense.

In addition, the terms like "the first" and "the second" are only used for descriptive purposes and are not to be construed as indicating or implying relative importance or implying quantity of the claimed features of technologies. Thus, a feature defined as "the first" or "the second" may explicitly or implicitly include at least one of the features. In the description of the present application, "several" means at least two unless there is an explicit specific limitation.

In the present application, unless expressly specified or limited otherwise the terms like "install", "connect", "joint", and "fix" should be construed broadly. For example, they can mean fixed connection, detachable connection or being integral; and can mean mechanically connection, electronical connection or being communicable; and can mean direct connection, secondary connection with intermediator, or the inner connection or interaction of two elements, unless there is specific limitation in the resent application. For those of ordinary skill in the art, the specific meanings of the above terms in the present application can be appreciated according to specific situations.

Figure 1:
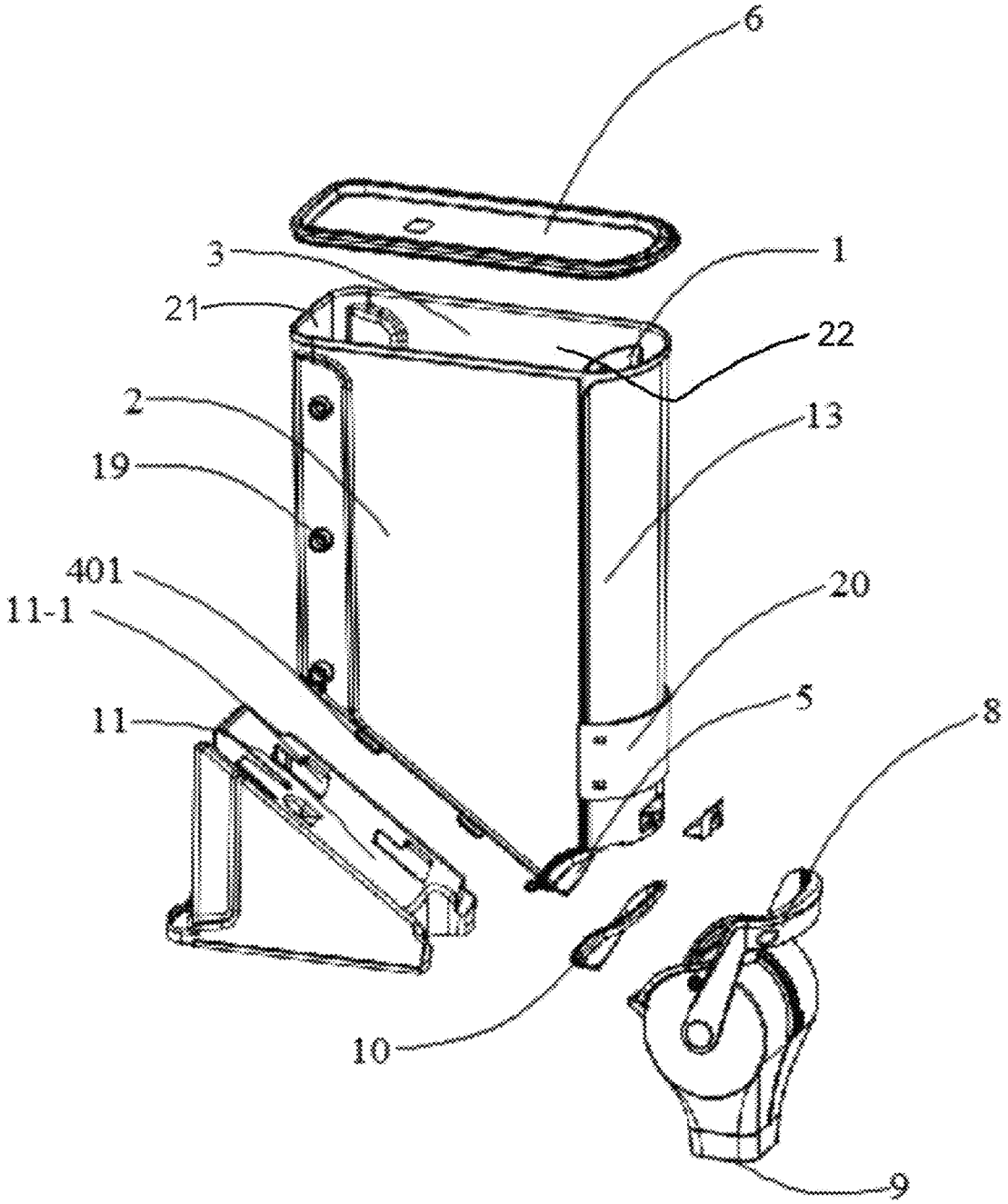
FIG. 1 is an exploded view of the present application.
Figure 2:
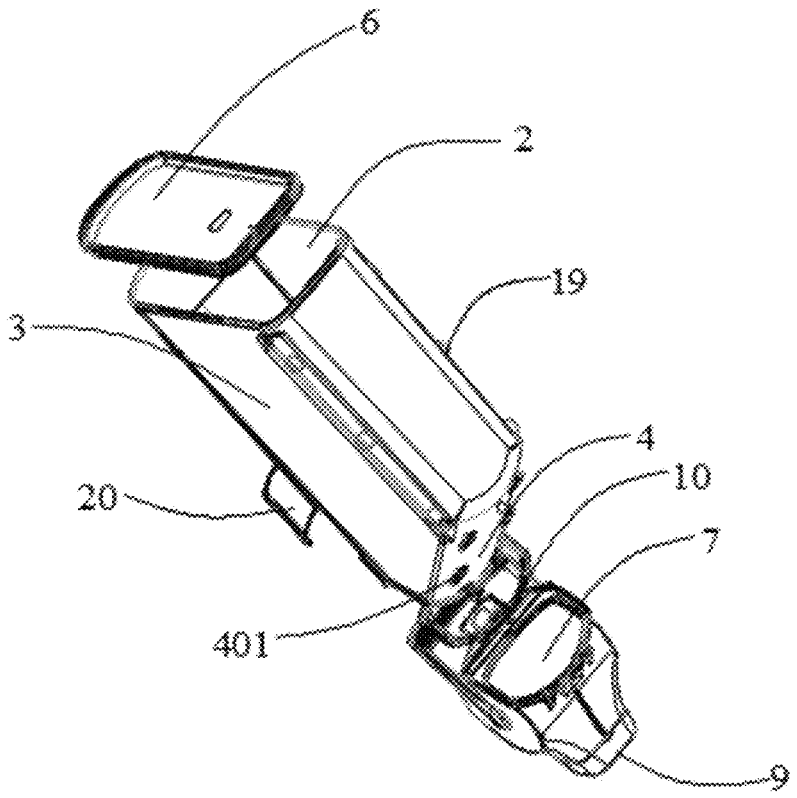
FIG. 2 is an exploded view of the present application which omits the fixing base.

Specifically, referring to the FIG. 1 and FIG. 2, a food gravity box with sealed flow channel for freshness preservation and display comprises:

- a container device integrally formed by injection molding that includes a display room and a storage room with semi-elliptical sections which are separated by a partition plate 1, wherein the storage room is composed of a partition plate 1, a front panel 2, a real panel 3 and a first side panel with a fillet and a first bottom panel 4 which is obliquely arranged, and a first discharging port 5 is formed in the bottom of the storage room;
- a sealing device used for sealing the feeding port in the upper portion of the container barrel;
- a discharging control device connected to the first discharging port 5, and the discharging device includes a flow path switch 7 used for sealing the discharging port 5, a twist handle 8 for pulling the flow path switch 7, and a second discharging port 9, wherein there is a first sealing ring 10 arranged between the discharging control device and the first discharging port 5.

Through the technical solution, the container device integrally formed by injection molding is only provided with two channels, namely the feeding port and the first discharging port 5, wherein the feeding port is sealed by the sealing device 6, and the joint of the first discharging port 5 and the discharging control device is sealed by the first sealing ring 10 and the flow path switch 7, so that the food in the gravity box is completely sealed and the fresh-keeping capacity of the gravity box is improved by integral sealing. The twist handle 8 is used for pulling the flow path switch 7 to move. When food is needed, the flow path switch 7 is pulled by the twist handle 8 to rotate, and the food in the storage room, under the action of gravity, will enter the discharging control device through the first discharge port 5 and then flow out through the second discharge port 9; when no food is needed, just need to close the flow path switch 7.

Figure 3:
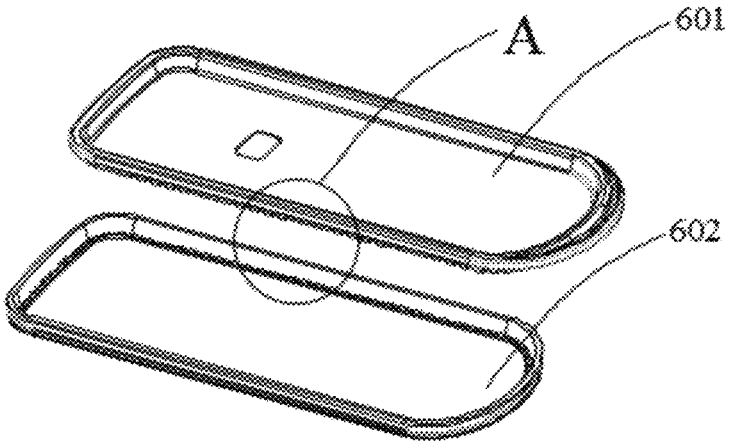
FIG. 3 is an exploded view of the sealing device of the present application.
Figure 4:
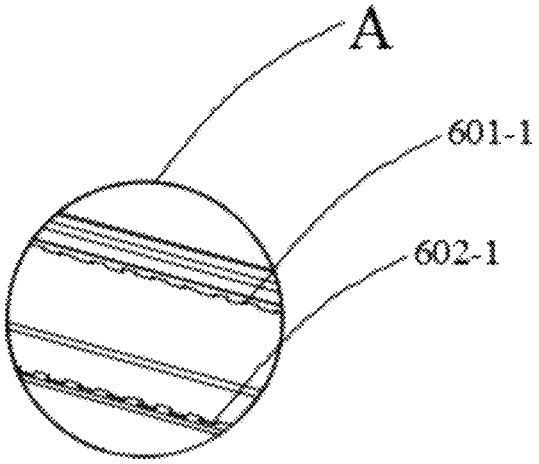
FIG. 4 is a partial view of the part A in the FIG. 3.

Specifically, as shown in FIG. 3 and FIG. 4, the sealing device 6 includes a sealing cover board 601 and a second sealing ring 602, wherein the sealing cover board 601 is provided with a convex serrated ring 601-1 along the bottom edge, and a concave serrated ring 602-1 is arranged at the bottom inner ring of the second sealing ring 602. The convex serrated ring 601-1 is snap connected to the concave serrated ring 602-1, wherein the convex serrated ring 601-1 is in hard rubber material while the concave serrated ring 602-1 is in soft rubber material.

Through the technical solution, the convex serration made of hard rubber materials is snap connected to the concave serration made of round soft material, which strengthen the sealing performance of the sealing device 6 to the feeding port.

Specifically, right below a first bottom panel 4, there is a fixing base in right-angled triangle which is provided with an inclined panel 11 attached to the first bottom panel 4. The first bottom panel 4 has a base buckle 401 and the inclined panel 11 is provided with a snap groove 11-1, wherein the base buckle 401 is embedded into the snap groove 11-1.

Through the technical solution, the fixing base in right-angled triangle is situated on the panel and the snap groove 11-1 on the inclined panel 11 is buckled with the base buckle 401, which ensures the stability of the gravity box when it is placed.

Figure 5:
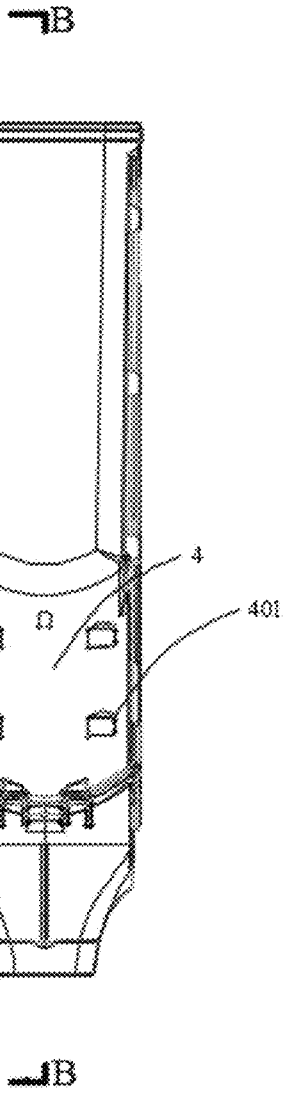
FIG. 5 is a left view of the present application which omits the fixing base.
Figure 6:
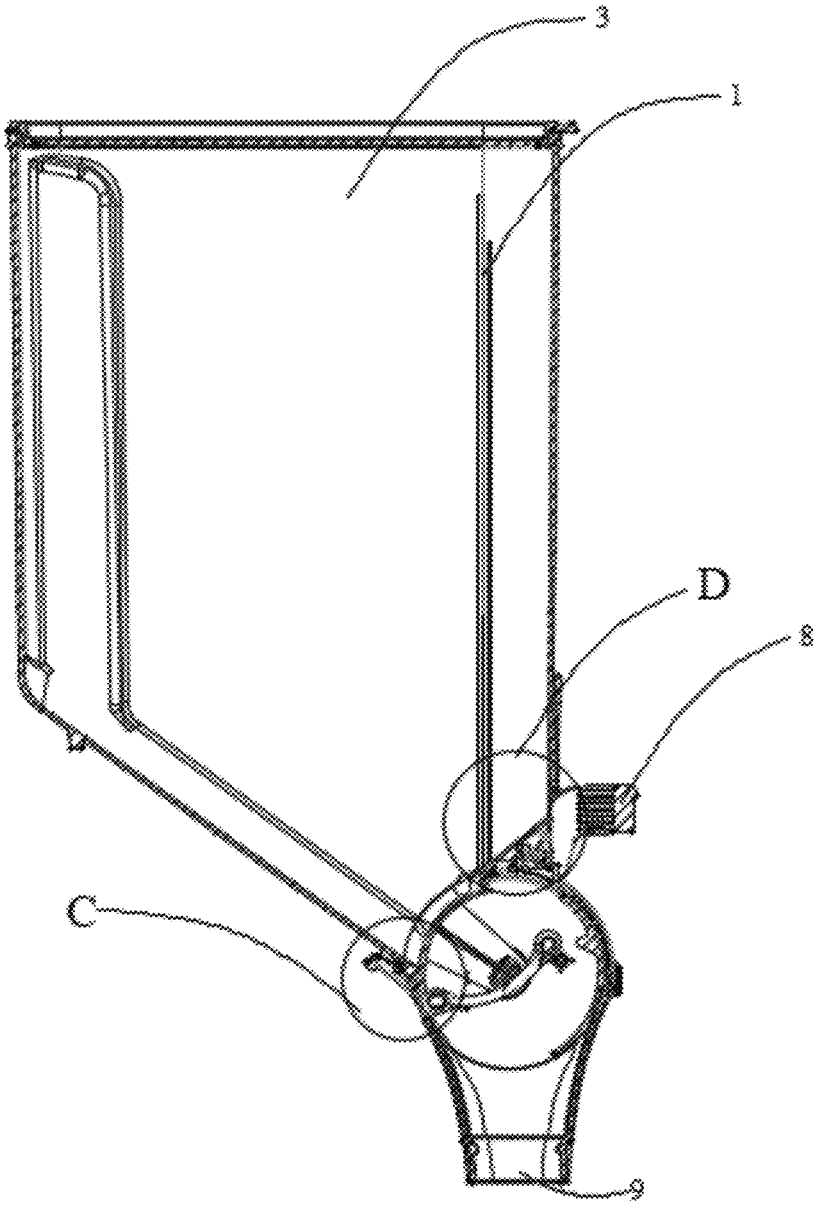
FIG. 6 is a partial view of the part B-B in the FIG. 5.
Figure 7:
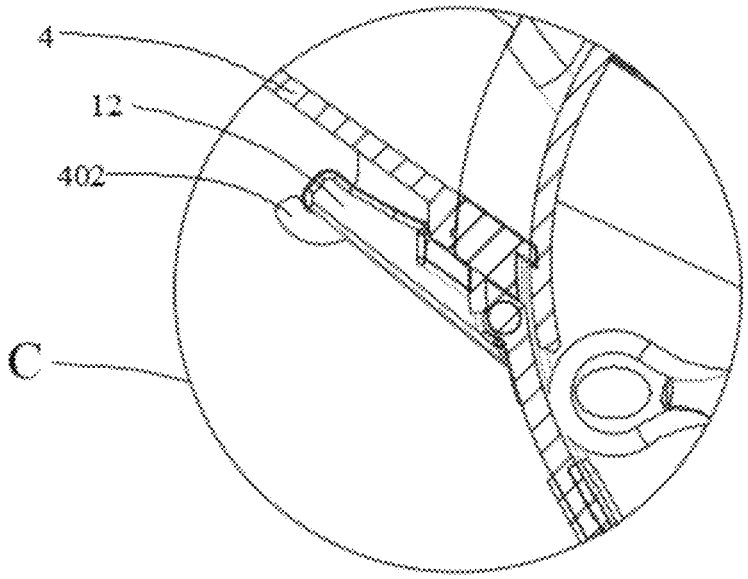
FIG. 7 is a partial view of the part C in the FIG. 6.

Specifically, referring to FIG. 5 to 7, the discharging control device is provided with a first hanging hole unit 12, and a first hanging buckle 402 is arranged on the section of the first bottom panel 4 close to the first discharge port 5, wherein the first hanging buckle 402 has an arc-shaped section and penetrates through the first hanging hole unit 12.

Through the technical solution, the first hanging buckle 402 penetrates through the first hanging hole unit 12, and because the cross section of the first hanging buckle 402 is arc-shaped, the buckling force of the discharging control device and the container device will be enhanced when the first hanging buckle 402 is rotated and buckled by taking itself as the origin. And the arc-shaped cross section of the first hanging buckle 402 facilitates the installation of the gravity box, which only needs to insert the first hanging buckle 402 into the first hanging hole unit 12 and then rotate the discharging control device.

Figure 8:
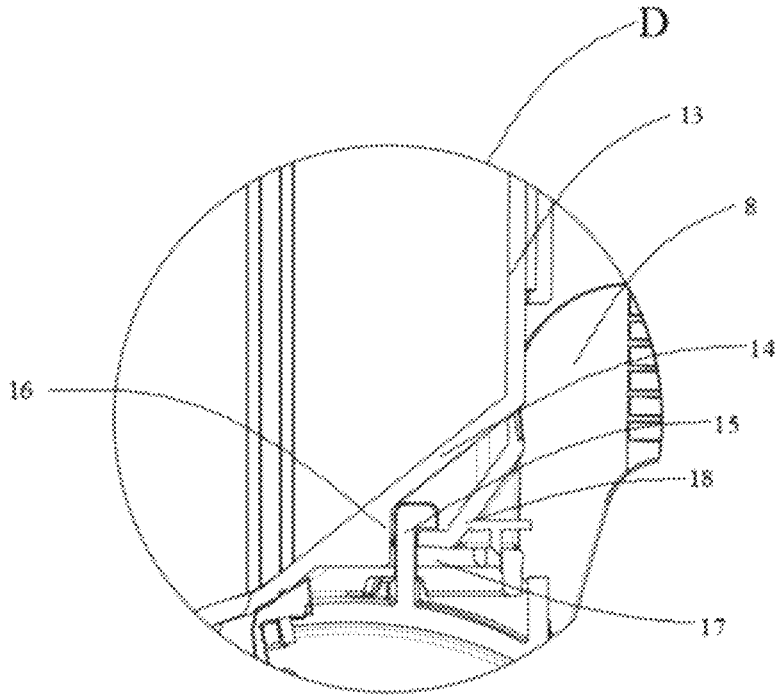
FIG. 8 is a partial view of the part D in the FIG. 6.
Figure 9:
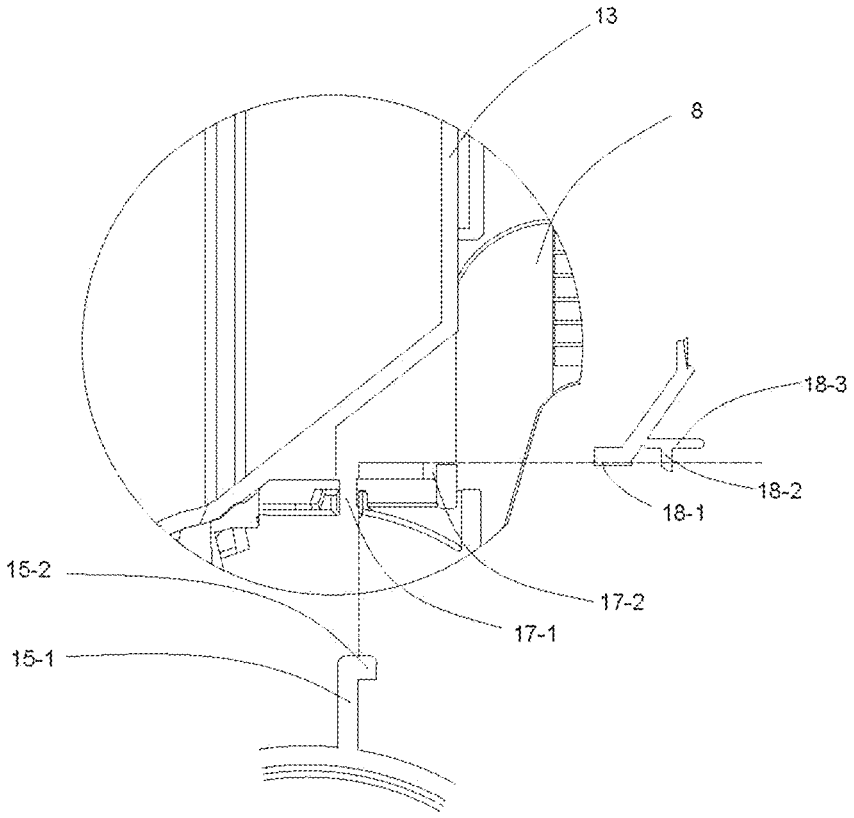
FIG. 9 is a location view of each part in the FIG. 8.

Specifically, referring to FIG. 8 to FIG. 9, the display room is composed of the partition plate 1, a second side panel 13 and a second bottom panel 14 arranged obliquely, wherein the second side panel 13 is made of transparent material. The bottom part of the display room has a second hanging hole unit composed of the second bottom panel 14 and the second side panel 13. The discharging control device is provided with a second hanging buckle 15 which is used for buckling the second hanging hole unit.

Through the technical solution, coordinating the first hanging hole unit 12 and the first hanging buckle 402, the second hanging hole unit and the second hanging buckle 15 fix the discharging control device and the container device through the two sides of the first discharging port 5, and ensure the sealing performance between the discharging control device and the container device with the first sealing ring 10. The second side panel 13 is made of transparent material which allows customers to observe the condition of food in the display room.

Specifically, the second hanging hole unit comprises the second bottom panel 14, a vertical plate 16 and a horizontal plate 17. The second hanging buckle 15 is in the shape of FIG. 7 and includes a support rod 15-1 and a fastener rod 15-2, wherein the support rod 15-1 runs through the hanging buckle channel 17-1 set on the hollow horizontal plate 17 and the fastener rod 15-2 is buckled and butting with the horizontal plate 17.

Specifically, the second hanging hole unit is internally provided with a detachable tightening buckle 18 which comprises a plug-in rod 18-1 and an elastic shifting piece 18-3 installed with a stop rod 18-2. The horizontal plate 17 has a hollow-out stop groove 17-2 for placing the stop rod 18-2.

The plug-in rod 18-1 is embedded between the fastener rod 15-2 and the horizontal plate 17 in order to intensify the buckling force so that it can improve the sealing performance between the discharging control device and the container device. Besides, the elastic shifting piece 18-3 in the tightening buckle 18 controls the relative position of the stop rod 18-2 and the stop groove 17-2, which makes it convenient to take out or installed the tightening buckle 18 and enhances the convenience of installing discharging control device and container device.

Specifically, the front panel 2 and the rear panel 3 are symmetrically provided with side bases 19, and through the side base 19 the gravity box can be fixed on the wall, and be various in its display ways.

Specifically, the surface of the second side panel 13 is provided with a detachable signboard 20 that clarifies the information of a product, including name, price, and production date, etc.

The installment method of this embodiment is as below: penetrating the first hanging buckle 402 through the first hanging hole unit 12; disposing the first sealing ring 10 at the first discharge port 5: rotating the discharging control device until the second hanging buckle 15 runs through the hanging buckle channel 17-1: inserting the tightening buckle 18: embedding the plug-in rod 18-1 between the fastener rod 15-2 and the horizontal plate 17: placing the stop rod 18-2 in the stop groove 17-2.

The convex serrated ring 601-1 is snap connected to the concave serrated ring 602-1 to form the sealing device 6, and the sealing device 6 is placed on the feeding port of the container device;

The base buckle 401 is embedded into the snap groove 11-1 and is fixed on a horizontal plate or on a vertical plate by using the side base 19.

The examples represent only a few embodiments of the present application.

Though these embodiments are described in sufficient detail, they should not be taken in a limiting sense of the scope of the present application. It is to be appreciated that those skilled in the art can practice the application, and other embodiments and changes may be made without departing from the scope of the present application. Therefore, the scope of the present application is defined only be the appended claims.

THE NUMERAL REFERENCES IN FIGURES partition plate 1
front panel 2
rear panel 3
first bottom panel 4; base buckle 401
first discharging port 5
sealing device including 6, sealing cover board 601; convex serrated ring 601-1; the second sealing ring 602: concave serrated ring 602-1;
flow path switch 7
twist handle 8
second discharging port 9
first sealing ring 10
inclined plane 11; snap groove 11-1
the first hanging hole unit 12; the first hanging buckle 402
the second side panel 13
the second bottom panel 14
the second hanging buckle 15; support rod 15-1; fastener rod 15-2
vertical plate 16
horizontal plate 17; hanging buckle channel 17-1; stop groove 17-2
tightening buckle 18; plug-in rod 18-1; stop rod 18-2; clastic shifting piece 18-3
side base 19
signboard 20
first side panel 21
upper feeding port 22

What is claimed:

1. A food gravity box with sealed flow channel for freshness preservation and display comprising:

a container device integrally formed through injection molding, wherein the container device comprises a display room with a semi-elliptical section and a storage room, the display room and the storage room are separated by a partition plate; wherein the storage room consists of the partition plate, a front panel, a rear panel, a first side panel with a fillet and a first bottom panel which is obliquely arranged, and a first discharging port is formed in the bottom of the storage room;

a sealing device configured for sealing up an upper feeding port of the container device;

a discharging control device communicated with the first discharging port, wherein the discharging control device comprises a flow path switch for sealing the first discharging port, a twist handle for pulling the flow path switch to rotate and a second discharging port; a sealing ring is arranged between the discharging control device and the first discharging port;

the display room is composed of the partition plate, a second side panel and a second bottom panel arranged obliquely; wherein the second side panel is made of transparent material; a bottom part of the display room has a second hanging hole unit composed of the second bottom panel and the second side panel; wherein the discharging control device is provided with a second hanging buckle which is used for buckling the second hanging hole unit.

2. The food gravity box of claim 1, wherein the sealing device comprises a sealing cover board and a second sealing ring; wherein the sealing cover board is provided with a convex serrated ring along a bottom edge, and a concave serrated ring is arranged at a bottom inner ring of the second sealing ring, wherein the convex serrated ring is buckled with the concave serrated ring, and the convex serrated ring is made of hard rubber material while the concave serrated ring is made of soft rubber material.

3. The food gravity box of claim 2, wherein a fixing base in a shape of a right-angled triangle is arranged right below the first bottom panel; wherein the fixing base is provided with an inclined panel attached to the first bottom panel and the first bottom panel is provided with a base buckle; wherein a snap groove is set on the inclined panel and the base buckle is embedded into the snap groove.

4. The food gravity box of claim 1, wherein the discharging control device is provided with a first hanging hole unit and a first hanging buckle is arranged on the section of the first bottom panel close to the first discharging port; wherein the first hanging buckle has an arc-shaped section and penetrates through the first hanging hole unit.

5. The food gravity box of claim 1, wherein the second hanging hole unit comprises the second bottom panel, a vertical plate and a horizontal plate; wherein the second hanging buckle comprises a support rod and a fastener rod, and the support rod and the fastener rod are arranged vertically to each other; wherein the a support rod runs through the hanging buckle channel set on the hollow horizontal plate and the fastener rod is butting and buckled with the horizontal plate.

6. The food gravity box of claim 5, wherein the second hanging hole unit is internally provided with a detachable tightening buckle which comprises a plug-in rod and an elastic shifting piece installed with a stop rod; wherein the horizontal plate has a hollow-out stop groove for placing the stop rod.

7. The food gravity box of claim 1, wherein the front panel and the rear panel are symmetrically provided with side bases.

8. The food gravity box of claim 1, wherein a second side panel surface is provided with a detachable signboard.

* * * * *